US005149064A

United States Patent [19]

Schulz, Jr.

[11] Patent Number: 5,149,064

[45] Date of Patent: Sep. 22, 1992

[54] FOUNDATION UNIT EDGE SUPPORT SYSTEM

[75] Inventor: Martin Schulz, Jr., Brenham, Tex.

[73] Assignee: Steadley Company, Carthage, Mo.

[21] Appl. No.: 671,541

[22] Filed: Mar. 19, 1991

[51] Int. Cl.[5] ..... F16F 3/02

[52] U.S. Cl. ..... 267/97; 267/88; 267/95; 267/105; 267/107; 5/262; 5/474

[58] Field of Search ..... 267/97, 95, 91, 98, 267/103, 104, 105, 107, 109, 86, 88; 5/261, 262, 474

[56] References Cited

U.S. PATENT DOCUMENTS

| | | | |
|---|---|---|---|
| 1,008,895 | 11/1911 | Feig | 5/262 X |
| 2,029,076 | 1/1936 | Leeman | 5/262 X |
| 2,145,408 | 1/1939 | Taylor | 267/91 |
| 3,121,882 | 2/1964 | Drews | 5/261 |
| 3,200,417 | 8/1965 | Costello | 5/261 X |
| 3,305,879 | 2/1967 | Krakauer | 5/261 X |
| 3,353,195 | 11/1967 | Kline | 5/261 |

*Primary Examiner*—George E. Halvosa
*Attorney, Agent, or Firm*—Lee, Mann, Smith, McWilliams, Sweeney & Ohlson

[57] ABSTRACT

An edge support system for a mattress foundation. The edge support system includes a pair of torsion elements, each including a central torsion segment, with the torsion segments being secured to one another, and with the torsion elements being formed as mirror images of one another, with legs being attached to the top and bottom border members of the mattress foundation. A secondary expansion spring is connected between the attached torsion segments and an intermediate rod located midway between the border members of the foundation. The gauge of the wire forming the torsion elements and the strength of the expansion spring determine the amount of support by the edge support system. A plurality of the system can be spaced about the periphery of the foundation to provide greater firmness in areas needing enhanced stiffness.

6 Claims, 1 Drawing Sheet

FOUNDATION UNIT EDGE SUPPORT SYSTEM

BACKGROUND OF THE INVENTION

This invention relates to foundation units such as mattresses, and more particularly to an edge support system for a mattress foundation, and the resulting mattress foundation, the edge support system being composed of a pair of interrelated torsion elements.

The outer edge of a mattress is often an area where increased firmness is desired, not only to support a sleeper without sagging in order to increase the usable surface of the mattress, but also to avoid a premature demise of the mattress due to excessive sagging at the outer edges of the mattress.

Edge supports for mattresses are available, but all are unsuccessful devices that are added on to an already-constructed mattress foundation, thus increasing the labor necessary before adding padding and covering material as well as the cost. Also, all prior supports are not totally compressible, and if incorporated in a mattress foundation which is compressed for shipping, such systems will not return to the fully uncompressed state, thus having a degree of set or loss of height, exacerbating a problem that such systems are supposed to prevent.

SUMMARY OF THE INVENTION

The invention provides an edge support system for a foundation unit, the foundation unit being of the type having spaced top and bottom bearing surfaces separated by rows of support members extending between opposite side edges of the foundation unit, and also having top and bottom border members at the side edges. The edge support system according to the invention is situated at the side edges of the foundation unit, and comprises first and second torsion elements. Each torsion element includes an elongated, horizontal torsion segment located between and generally parallel to the top and bottom border members and offset inwardly in the foundation unit. A first connection leg extends between one end of each torsion segment and the top border member, and a second connection leg extends between the other end of each torsion segment and the bottom border member. Both connection legs are secured to their respective border members. The torsion segments of the two torsion elements are located contiguous to one another, with one connection leg of each torsion element being located above one connection of the other torsion element, with the torsion elements therefore being essentially mirror images of one another. Means is provided for attaching the torsion segments to one another.

In accordance with the preferred form of the invention, the means for securing the connection legs to the respective border members each comprises a connection element extending outwardly from its associated connection leg, and means connecting the connection member to a border member. Each border member preferably comprises a wire, and the connecting means comprises a spiral wire pigtail extending about the border member and each connection element.

Also in accordance with the preferred form of the invention, an expansion spring is connected at one end to the attached torsion segments and at its other end to a fixed position in the foundation unit located between the top and bottom border members. The fixed position preferably is on an intermediate rod which is located midway between the upper and lower border members. The rod is secured to the support members and is also offset inwardly in the foundation unit. At least one of the torsion segments includes a central bend for attachment of the expansion spring.

It is preferred that the torsion segments be attached to one another by means of a series of metal clips. Other means can be used as well. It is also preferred that a foundation unit be formed using a plurality of the edge support systems according to the invention to impart greater firmness in the outer edge of a mattress in areas desired.

BRIEF DESCRIPTION OF THE DRAWINGS

The invention is described in greater detail in the following description of an example embodying the best mode of the invention, taken in conjunction with the drawing figures, in which.

DESCRIPTION OF EXAMPLES EMBODYING THE BEST MODE OF THE INVENTION

Figure 1:
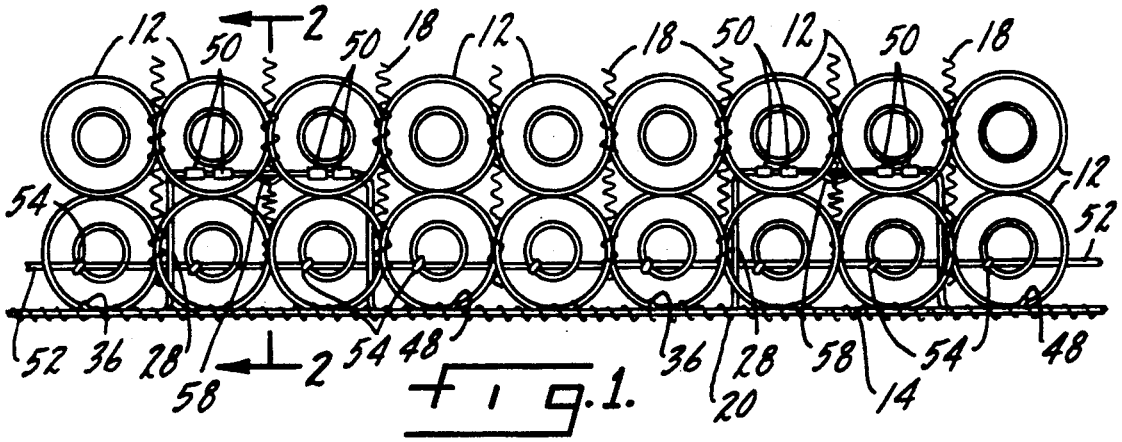
FIG. 1 is a top plan view of a portion of a mattress foundation, employing a pair of the edge support systems according to the invention.

An edge support system according to the invention, which is generally designated at 10 in the drawing figures, is installed in a conventional mattress foundation, a portion of which is shown in FIG. 1. The mattress foundation consists of a plurality of parallel rows and columns of support members in the form of spring coils 12, which extend between the limits of upper and lower border wires 14 and 16, the border wires extending in a conventional fashion about the entire periphery of the mattress foundation.

The coils 12 are joined to one another with a series of conventional pigtails 18, comprising spirally wound wires extending the width of the mattress foundation. The pigtails 18 connect both the top and bottom convolutes of the coils 12. Similarly, the outermost coils 12 are joined to the upper and lower border wires 14 and 16 by a pair of pigtails 20. Alternatively, the top and bottom of the mattress foundation may be formed in a conventional grid structure, with the coils 12 being secured to the intersecting wires of the grids with conventional metal clips. Also as an alternative, a snap-in type structure, such as disclosed in U.S. Pat. No. 3,953,903 can be employed to secure the coils 12 in place. How the coils 12 are held in place, and the basic form of the mattress foundation, form no part of the invention.

Figure 2:
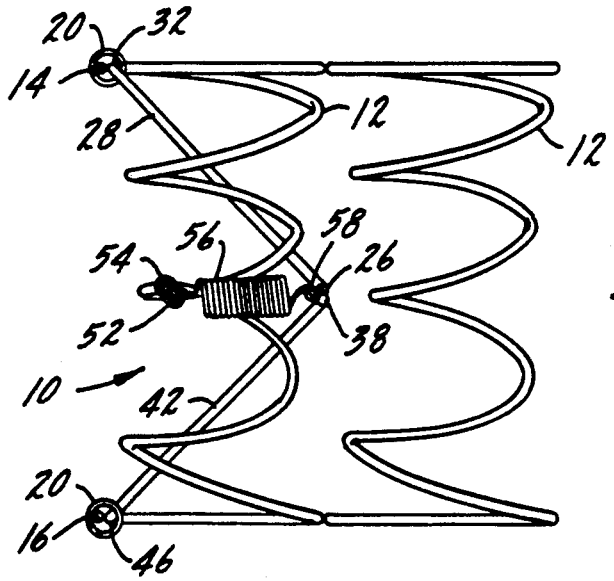
FIG. 2 is an enlarged cross sectional view taken along lines 2—2 of FIG. 1.
Figure 3:
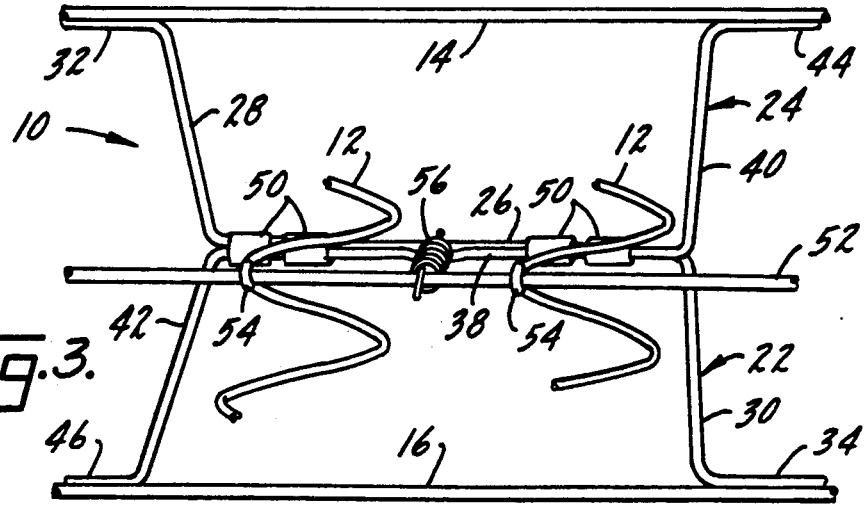
FIG. 3 is an enlarged side elevational view of a single edge support system according to the invention (looking at the left side of FIG. 2), when installed in a foundation unit, and with portions broken away or eliminated to better illustrate detail.

The edge support system 10 is composed of a pair of torsion elements 22 and 24 which, as best shown in FIGS. 2 and 3, are complementary to one another, as will become evident below. The torsion element 22 is composed of an elongated, horizontal torsion segment 26 located between, and generally parallel to, the upper and lower border wires 14 and 16 but, as shown in FIG. 2, is offset inwardly in the foundation unit when installed. The torsion element 22 is preferably formed from a single length of bent wire, and includes a first connection leg 28 extending from one end of the torsion segment 26, and a second connection leg 30 extending from the opposite end of the torsion segment 26. The connection legs 28 and 30 extend at angles from their respective ends of the torsion segment 26 to the upper and lower border wires 14 and 16, respectively, where respective connection elements 32 and 34 extend outwardly from each connection leg 28 and 30. The connection elements 32 and 34 are captured within the pigtails 20 extending about the upper and lower border wires 14 and 16. To assure appropriate orientation in the foundation unit, each connection element terminates at an in-turned foot. The foot 36 at the end of the connection element 32 is shown in FIG. 1

The torsion element 24 is similar to the torsion element 22, and comprises a torsion segment 38 extending contiguous to the torsion segment 26. Opposite connection legs 40 and 42 extend from opposite ends of the torsion segment 38. The connection leg 40 terminates at a connection element 44, while the connection leg 42 terminates at a connection element 46. Both connection elements are captured by the pigtails 20. Each of the connection elements terminates at an in-turned foot, a foot 48 for the connection element 44 being shown in FIG. 1, and that for the connection element 4 being identical.

The torsion segments 26 and 38 are secured to one another with a series of metal clips 50, thus joining the torsion elements 22 and 24 as an integral unit of the edge support system 10. While the clips 50 are preferred, other means of joining the torsion segments 26 and 38 might be employed, as well.

An intermediate rod 52 extends along the outer column of coils 12 which is adjacent the upper and lower border wires 14 and 16. The intermediate rod 52 is attached to each of the coils 12 by a wire clip 54, and as best shown in FIGS. 2 and 3, is located midway between the border wires 14 and 16, and offset inwardly in the mattress foundation.

Each edge support system 10 includes a central expansion spring 56 extending between the centers of the torsion segments 26 and 38 and the intermediate rod 52. Since the torsion segments 26 and 38 are secured to one another, the expansion spring 56 need be attached to only one of the torsion segments. To assure proper centering of the expansion spring 56, the torsion segment 38 includes a bend 58 to which the expansion spring 56 is attached.

Achievements

Depending on the gauge of the wire used to form the torsion elements 22 and 24, and depending upon the strength of the expansion spring 56, the edge support system 10 according to the invention adds 25% or more greater firmness to the outer edge of a mattress foundation, thus allowing the edge of the foundation to support the weight of an individual without sagging. This elimination of sagging increases the effective usable surface of a mattress foundation, and also increases the life of a mattress, since one of the first locations of failure of a mattress is often at its outer periphery.

The edge support system 10 according to the invention is very strong, yet it is totally compressible which allows the edge support system to be installed in a mattress foundation when formed, and then compressed and crated for shipment to the customer, who completes the mattress by adding padding and an appropriate cover. This permits the edge support system according to the invention to be an internal part of the mattress foundation, without the need for the customer to install any separate edge support once the foundation has been received and released from its compressed state.

As explained above, the edge support system 10 according to the invention is totally compressible with the compression of the mattress foundation. While other edge supports have been produced in the past, all are composed of elements that must be added to an already-formed mattress foundation by the customer, and none is totally compressible. If totally compressed, other such edge supports form a set, which defeats the purpose of the edge support.

The edge support system 10 employs a pair of torsion elements 22 and 24 which support one another due to their joining by the metal clips 50. However, when compression force is applied to the mattress foundation, each of the torsion elements 22 and 24 pivot independently of the other with twisting torsion of the torsion segments 26 and 38 being independent of one another. With the addition of the tightly wound expansion spring 56 and intermediate control rod 52, additional support and variations in firmness can be achieved without changing the gauge of the wire forming the torsion elements 22 and 24.

The torsion elements 22 and 24 are essentially opposite or mirror images of one another. Thus, the torsion elements 22 and 24 form a totally balanced unit when joined by the clip 50 to form a portion of the edge support system 10.

A plurality of the edge support systems 10 according to the invention is employed in each mattress foundation. The number of edge support systems 10 will depend on the size of the mattress, and ultimate edge firmness desired, and areas in which extra firmness is sought.

Various changes can be made to the invention without departing from the spirit thereof or scope of the following claims.

What is claimed is:

1. An edge support system for a foundation of the type having spaced top and bottom bearing surfaces separated by rows of support members extending between opposite side edges of the foundation, the foundation also having top and bottom border members at said side edges, the edge support system being situated at a side edge and comprising a. a first torsion element comprising i. an elongated, horizontal torsion segment located between and generally parallel to said top and bottom border members and offset inwardly in said foundation, ii. a first connection leg extending between one end of said torsion segment and said top border member, iii. means securing said first connection leg to said top border member, iv. a second connection leg extending between the other end of said torsion segment and said bottom border member, v. means securing said second connection leg to said bottom border member, b. a second torsion element comprising i. an elongated, horizontal torsion segment located between and generally parallel to said top and bottom border members and offset inwardly in said foundation, ii. a first connection leg of said second torsion element extending between one end of said second torsion segment and said top border member, iii. means securing said first connection leg of said second torsion element to said top border member, iv. a second connection leg of said second torsion element extending between the other end of said second torsion segment and said bottom border member, v. means securing said second connection leg of said second torsion element to said bottom border member, c. said torsion segments being located contiguous to one another, with the first connection leg of said first torsion element being located above the second connection leg of said second torsion element and with the first connection leg of said second torsion element being located above the second connection leg of said first torsion element, d. means attaching said torsion segments to one another, and e. an expansion spring having opposite ends and being connected at one end to said attached torsion segments and being connected at the opposite end to an intermediate rod located midway between said upper and lower border members, said rod being secured to said support members and being offset inwardly in said foundation while remaining generally parallel to said lower and upper border members, and said one end of said expansion spring being connected to a bend in at least one of said torsion segments.

2. An edge support system according to claim 1 in which each said securing means comprises a connection element extending from said connection leg, and means connecting said connection element to a border member.

3. An edge support system according to claim 2 in which each border member comprises a wire, and said connecting means comprises a spiral pigtail extending about said border member and said connection element.

4. An edge support system according to claim 1 in which each torsion element comprises a continuous wire.

5. An edge support system according to claim 1 in which said attaching means comprises metal clips.

6. A foundation unit having a plurality of edge supports as set forth in claim 1.

* * * * *